US006475312B1

(12) United States Patent
Burns et al.

(10) Patent No.: US 6,475,312 B1
(45) Date of Patent: Nov. 5, 2002

(54) METHOD OF FORMULATING A GAS GENERANT COMPOSITION

(75) Inventors: Sean P. Burns, Almont, MI (US); Paresh S. Khandhadia, Troy, MI (US)

(73) Assignee: Automotive Systems Laboratory, Inc., Farmington Hills, MI (US)

( * ) Notice: Subject to any disclaimer, the term of this patent is extended or adjusted under 35 U.S.C. 154(b) by 0 days.

(21) Appl. No.: 09/544,694

(22) Filed: Apr. 7, 2000

Related U.S. Application Data

(63) Continuation-in-part of application No. 09/516,067, filed on Mar. 1, 2000, now Pat. No. 6,287,400.

(60) Provisional application No. 60/128,101, filed on Apr. 7, 1999, and provisional application No. 60/130,660, filed on Apr. 23, 1999.

(51) Int. Cl.[7] ..... D03D 23/00; C06B 31/28

(52) U.S. Cl. ..... 149/109.6; 149/46

(58) Field of Search ..... 149/109.6, 46, 149/61

(56) References Cited

U.S. PATENT DOCUMENTS

| | | | | | |
|---|---|---|---|---|---|
| 3,457,127 | A | | 7/1969 | Cook et al. | 149/46 |
| 3,734,789 | A | | 5/1973 | Moy et al. | 149/19 |
| 3,779,822 | A | * | 12/1973 | Stammler et al. | 149/19.4 |
| 3,881,970 | A | * | 5/1975 | Falconer et al. | 149/47 |
| 3,898,112 | A | | 8/1975 | Strecker et al. | 149/19.9 |
| 3,909,322 | A | * | 9/1975 | Chang et al. | 149/19.4 |
| 4,334,060 | A | * | 6/1982 | Blais | 536/35 |
| 4,352,699 | A | * | 10/1982 | Zeigler | 149/109.6 |
| 4,419,155 | A | * | 12/1983 | Wagaman et al. | 149/109.6 |
| 4,701,227 | A | * | 10/1987 | Loverro | 149/109.6 |
| 4,707,540 | A | * | 11/1987 | Manser et al. | 528/417 |
| 4,761,250 | A | * | 8/1988 | Frankel et al. | 149/92 |
| 5,035,757 | A | | 7/1991 | Poole | 149/46 |
| 5,386,775 | A | * | 2/1995 | Poole et al. | 102/289 |
| 5,472,534 | A | * | 12/1995 | Wardle et al. | 149/109.6 |
| 5,472,647 | A | | 12/1995 | Blau et al. | 264/3.1 |
| 5,516,377 | A | * | 5/1996 | Highsmith et al. | 149/18 |
| 5,531,941 | A | | 7/1996 | Poole | 264/3.4 |
| 5,714,714 | A | * | 2/1998 | Stern et al. | 149/109.6 |
| 5,847,315 | A | | 12/1998 | Katzakian et al. | 149/19.91 |
| 5,872,329 | A | | 2/1999 | Burns et al. | 149/36 |
| 5,962,808 | A | * | 10/1999 | Lundstrom | 149/19.1 |
| 6,017,404 | A | | 1/2000 | Lundstrom et al. | 149/36 |
| 6,074,502 | A | * | 6/2000 | Burns et al. | 149/36 |
| 6,149,746 | A | * | 11/2000 | Blomquist | 149/46 |

* cited by examiner

*Primary Examiner*—Michael J. Carone
*Assistant Examiner*—Aileen J. Baker
(74) *Attorney, Agent, or Firm*—Dinnin & Dunn, P.C.

(57) ABSTRACT

Preferred gas generant compositions incorporate a combination of 5-aminotetrazole nitrate and an oxidizer. The oxidizer may be selected from a group including nonmetal and metal nitrates, nitrites, chlorates, chlorites, perchlorates, and oxides. 5-aminotetrazole nitrate is characterized as an oxygen-rich fuel and is therefore considered to be a self-deflagrating fuel. To tailor the oxygen balance in certain applications, however, the use of an oxidizer is preferred. Methods of formulating the compositions are also described. These compositions are especially suitable for inflating air bags and actuating seatbelt pretensioners in passenger-restraint devices.

4 Claims, 5 Drawing Sheets

METHOD OF FORMULATING A GAS GENERANT COMPOSITION

CROSS REFERENCE TO RELATED APPLICATIONS

This application claims the benefit of U.S. Provisional Application Nos. 60/128,101 and 60/130,660 filed on Apr. 7, 1999 and Apr. 23, 1999, respectively. This application is also a continuation-in-part of U.S. application Ser. No. 09/516,067 filed on Mar. 1, 2000 now U.S. Pat. No. 6,287,400.

BACKGROUND OF THE INVENTION

Field of the Invention

The present invention relates to nontoxic gas generating compositions that when combusted rapidly generate gases that are useful for actuating vehicle occupant restraint systems in motor vehicles and specifically, the invention relates to thermally stable nonazide gas generants having not only acceptable burn rates and sustained combustion, but also a relatively high gas volume to solid particulate ratio at acceptable flame temperatures.

The evolution from azide-based gas generants to nonazide gas generants is well-documented in the prior art. The advantages of nonazide gas generant compositions in comparison with azide gas generants have been extensively described in the patent literature. See for example, U.S. Pat. Nos. 4,370,181; 4,909,549; 4,948,439; 5,084,118; 5,139,588, 5,035,757, 5,386,775, and 5,872,329, the discussions of which are hereby incorporated by reference.

In addition to a fuel constituent, pyrotechnic nonazide gas generants often contain ingredients such as an oxidizer to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. The solids produced as a result of combustion must be filtered and otherwise kept away from contact with the occupants of the vehicle. It is therefore highly desirable to develop compositions that produce a minimum of solid particulates while still providing sufficient quantities of a nontoxic gas to inflate the safety device at an acceptable rate.

The use of phase stabilized ammonium nitrate is desirable because it generates abundant nontoxic gases and minimal solids upon combustion. To be useful, however, gas generants for automotive applications must be thermally stable.

Often, gas generant compositions incorporating phase stabilized or pure ammonium nitrate exhibit poor thermal stability, and produce unacceptably high levels of toxic gases, CO and $NO_x$, for example, depending on the composition of the associated additives such as plasticizers and binders. In addition, ammonium nitrate contributes to poor ignitability, lower burn rates, and performance variability. Several known gas generant compositions incorporating ammonium nitrate utilize well-known ignition aids such as $BKNO_3$ to solve this problem. However, the addition of an ignition aid such as $BKNO_3$ is undesirable because it is a highly sensitive and energetic compound, and furthermore, contributes to thermal instability and an increase in the amount of solids produced.

Certain gas generant compositions comprised of ammonium nitrate are thermally stable, but have burn rates less than desirable for use in gas inflators. To be useful for passenger restraint inflator applications, gas generant compositions generally require a burn rate of at least 0.4 inch/second (ips) or more at 1000 psi. Gas generants with burn rates of less than 0.40 ips at 1000 psi do not ignite reliably and often result in "no-fires" in the inflator.

Yet another problem that must be addressed is that the U.S. Department of Transportation (DOT) regulations require "cap testing" for gas generants. Because of the sensitivity to detonation of fuels often used in conjunction with ammonium nitrate, most propellants incorporating ammonium nitrate do not pass the cap test unless shaped into large disks, which in turn reduces design flexibility of the inflator.

The compositions described in U.S. Pat. No. 5,035,757 to Poole exemplify state of the art gas generant compositions that function well but produce relatively large amounts of solid combustion products. As a result, the gas produced is less than that produced by current state of the art "smokeless" gas generants. Thus, more gas generant and greater filtering requirements are required to facilitate operation of an airbag inflator.

On the other hand, compositions described in U.S. Pat. No. 5,872,329 to Burns et al. exemplify current state of the art "smokeless" gas generants. The combustion products are primarily gas with minimal formation of solids. The benefits include a reduction in the amount of gas generant required and reduced filtering requirements. However, certain compositions described by Burns may be disadvantaged by lower burn rates and a failure to sustain gas generant combustion. To overcome these disadvantages, a stronger and more robust inflator is often required to increase the operating pressure of the inflator and thereby improve the burn of the gas generant.

Accordingly, it would be an improvement in the art to provide the gas generant burn characteristics of compounds as described in U.S. Pat. No. 5,035,757 along with the capacity to produce more gas and less solids as typified by state of the art "smokeless" gas generants.

SUMMARY OF THE INVENTION

The present invention generally relates to gas generant compositions useful in actuating a vehicle occupant restraint system in the event of a motor vehicle accident. Application within a vehicle occupant restraint system includes actuation of a seatbelt pretensioner and/or inflation of an airbag. Other applications requiring gas generation are also contemplated, including fire suppression systems aboard aircraft and inflators for flotational devices, for example.

The above-referenced problems are reconciled by compositions containing 5-aminotetrazole nitrate (5ATN) as a fuel at about 25–100% by weight of the total composition. An oxidizer is selected from a group of compounds including phase stabilized ammonium nitrate, ammonium nitrate, potassium nitrate, strontium nitrate, copper dioxide, and basic copper nitrate. Other oxidizers well known in the art are also contemplated. These generally include but are not limited to inorganic oxidizers such as alkali and alkaline earth metal nitrates, nitrites, chlorates, chlorites, perchlorates, and oxides.

Standard binders, slag formers, and coolants may also be incorporated if desired.

A composition in accordance with the present invention contains by weight 25–95% 5ATN and 5–75% of an oxidizer. A more preferred composition consists of 55–85% 5ATN and 20–45% PSAN.

A method of formulating compositions of the present invention includes providing an excess amount of nitric acid (preferably 15.9M or less and preferably chilled at 0–20° C.), and then, in the appropriate amounts, adding a nitratable fuel such as 5-aminotetrazole and at least one oxidizer to the nitric acid. The slurry is stirred until a damp or wet paste forms. The paste is then formed into the desired shapes and dried.

BRIEF DESCRIPTION OF THE FIGURES

FIG. 3 illustrates a comparison of pressure vs. time in a 40 cc tank with respect to state of the art compositions, preferred embodiments of the present invention and control compositions.

FIG. 6 illustrates the infrared scans of 5-AT, AN, KN, and the 5-AT.$HNO_3$/PSAN10 mixture. The presence of strong nitrate peaks and shifts in the N-H peaks affirms the formation of 5-AT.$HNO_3$ when the composition is formulated as described herein.

DESCRIPTION OF THE PREFERRED EMBODIMENTS

Figure 1:
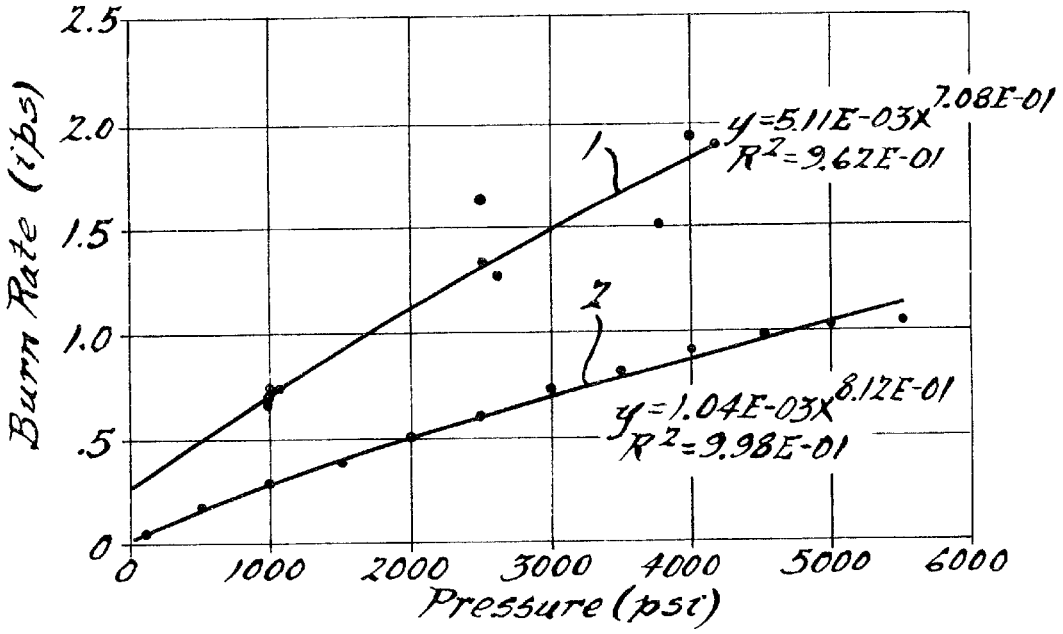
FIG. 1 illustrates the burn rate of state of the art "smokeless" gas generants as compared to a preferred embodiment of the present invention.

The gas generants of the present invention when compared to other state of the art gas generants ignite easier, produce minimal solids, exhibit improved burn rates, are thermally stable, and sustain a burn at lower pressures.

In accordance with the present invention, 5-aminotetrazole nitrate (5-ATN) is provided at 25–100% by weight of the gas generant, depending on the application. 5-ATN is characterized as an oxygen-rich fuel attributed to the oxygen in the nitrate group. The use of 5-ATN within a gas generant composition therefore requires little or no additional oxidizer, again depending on the application. 5-ATN is more preferably provided at 30–95% by weight and most preferably provided at 55–85% by weight of the gas generant composition.

In certain applications, the oxygen balance must be tailored to accommodate reduced levels of carbon monoxide (CO) and nitrogen oxides (NOx) as driven by original equipment manufacturer toxicity requirements. For example, the gas generated upon combustion of a gas generant within a vehicle occupant restraint system must minimize or eliminate production of these toxic gases. Therefore, when adding an oxidizer to 5-ATN, it is generally understood that an oxygen balance of about −4.0 to +4.0 is desirable when the gas generant is used in an airbag inflator. The preferred percentages of 5-ATN reflect this characteristic.

One or more oxidizers may be selected from the group including nonmetal, alkali metal, and alkaline earth metal nitrates, nitrites, perchlorates, chlorates, and chlorites for example. Other oxidizers well known in the art may also be used. These include alkali, alkaline earth, and transitional metal oxides, for example. Preferred oxidizers include phase stabilized ammonium nitrate (PSAN), ammonium nitrate, potassium nitrate, and strontium nitrate. The oxidizer(s) is provided at 5–70% by weight of the gas generant composition and more preferably at 20–45% by weight of the oxidizer.

Standard additives such as binders, slag formers, burn rate modifiers, and coolants may also be incorporated if desired. Inert components may be included and are selected from the group containing clay, silicon, silicates, diatomaceous earth, and oxides such as glass, silica, alumina, and titania. The silicates include but are not limited to silicates having layered structures such as talc and the aluminum silicates of clay and mica; aluminosilicate; borosilicates; and other silicates such as sodium silicate and potassium silicate. The inert component is present at about 0.1–20% by weight, more preferably at about 0.1–8%, and most preferably at 0.1–3%.

A most preferred embodiment contains 73.12% 5-ATN and 26.88% PSAN10 (ammonium nitrate stabilized with 10% potassium nitrate). The invention is further exemplified by the following examples.

EXAMPLE 1

5ATN was prepared according to the following method. In an ice bath, 20 g (0.235 moles) of anhydrous 5-aminotetrazole and 22 ml (0.350 moles) of concentrated nitric acid were stirred for about one hour. About 70 ml of water was added directly to the slurry, and the entire mixture was heated quickly to boiling. The hot solution was vacuum filtered and allowed to cool at ambient conditions while stirring. The white crystals formed during cooling were vacuum filtered and washed with cold water, then forced through a No. 14 mesh screen to form granules. The wet material was dried for one hour at ambient conditions and formed well-flowing granules.

As determined by TGA, the 5ATN dried at ambient conditions contained about 1.0 wt % water. As tested on a BOE impact apparatus, this material showed no positive fires up to 25 inches (equivalent to about 231 kp.cm).

EXAMPLE 2

The 5ATN granules prepared in Example 1 were dried at 105 degrees Celsius for 4 hours to remove any remaining moisture. Elemental analysis for C, H, and N showed by weight 8.36% carbon, 2.71% hydrogen, and 56.71% nitrogen. The theoretical values by weight are 8.11% C, 2.72% H, 56.75% N, and 32.41% O.

As tested on a BOE impact apparatus, this material showed positive fires at about 4 inches (equivalent to about 37 kp.cm). This demonstrates how 5ATN experiences an increase in impact sensitivity when completely dry.

The dried 5ATN was tested using a DSC at a heating rate of 10 degrees Celsius per minute. The 5ATN melted at 156.8 degrees Celsius and then decomposed exothermically with an onset of 177.2 degrees Celsius and a peak of 182.5 degrees Celsius. The 5ATN was also tested using a TGA at a heating rate of 10 degrees Celsius per minute and found to have an 89.3 wt. % gas conversion up to 450 degrees Celsius, with a 67.5 wt. % gas conversion up to about 194 degrees Celsius. The DSC and TGA data show that the 5ATN autoignites at about 180 degrees Celsius with a large release of energy.

EXAMPLE 3

The wet 5ATN granules as prepared in Example 1 were compression molded in a 0.5 inch die under a 10-ton force to a height of about 0.1 inches. About half of the pellets were dried for 4 hours at 70 degrees Celsius to remove all the moisture. A weight loss of about 1.0 wt. % confirmed that all of the moisture had been removed.

Both the wet and dry 5ATN pellets were tested as a booster material using the following specifications. Each pellet was broken into four pieces and the fragments were loaded into a small aluminum cup. This aluminum cup was then crimped to a standard air bag initiator that contained 110 mg of zinc potassium perchlorate (ZPP). The entire assembly, known as an igniter, was fired inside a closed bomb with a volume of 40 cubic centimeters. The 40 cubic centimeter bomb was equipped with a pressure transducer to measure the pressure rise over time.

FIG. 3 shows the results of the tests. Other control tests were done as a comparison to the igniters containing 5ATN. Tests 7 and 8 (initiator) are igniters consisting of an empty aluminum cup crimped to an initiator. Tests 9 and 10 are control igniters containing both an autoignition material and 8 pellets of a standard nonazide composition as described in U.S. Pat. No. 5,035,757. Test 11 is another control igniter similar to tests 9 and 10, except with autoignition material and 14 pellets of the same nonazide composition. Test 12 is an igniter containing about 0.7 g of undried 5ATN pellet fragments Test 13 is an igniter containing about 1.0 g of undried 5ATN pellet fragments. In all cases, the igniters containing 5ATN ignited readily and actually reached peak pressure sooner than the control igniters. In both tests 11 and 13, the volume of the aluminum cup was completely full. As shown in FIG. 3, for an equivalent volume of material, the output of the 5ATN igniter (13) is about twice that of the control igniter containing the state of the art propellant (11).

EXAMPLE 4

A composition was prepared containing 77.77 wt. % 5ATN and 22.23 wt. % strontium nitrate. The 5ATN as prepared in Example 1 and dried strontium nitrate were combined to form an overall mass of 0.71 g and then mixed and ground with a mortar and pestle. The composition was tested by DSC at a heating rate of 5 degrees Celsius per minute and found to melt at 155.3 degrees Celsius and then decomposed with a large exotherm (175.6 degrees Celsius onset, 179.4 degrees Celsius peak). The composition was tested by TGA at a heating rate of 10 degrees Celsius per minute and found to have a 91.7 wt. % gas conversion up to 950 degrees Celsius, with a 74.1 wt. % gas conversion up to about 196 degrees Celsius. As tested on a BOE impact apparatus, this composition showed positive fires at about 3 inches (equivalent to about 28 kp.cm). This composition burned vigorously when ignited with a propane torch.

EXAMPLE 5

A composition was prepared containing 65.05 wt. % 5ATN and 34.95 wt. % copper (II) oxide. The 5ATN as prepared in Example 1 and the dried copper oxide were combined to form an overall mass of 0.52 g and then mixed and ground with a mortar and pestle. The composition was tested by DSC at a heating rate of 10 degrees Celsius. per minute and found to decompose with a large exotherm peaking at about 175 degrees Celsius. The composition was tested by TGA at a heating rate of 10 degrees Celsius per minute and found to have an 83.4 wt. % gas conversion up to 400 degrees Celsius, with an 80.6 wt. % gas conversion up to about 183 degrees Celsius. As tested on a BOE impact apparatus, this composition showed positive fires at about 3 inches (equivalent to about 28 kp.cm). This composition burned vigorously when ignited with a propane torch.

EXAMPLE 6

A composition was prepared containing 65.05 wt. % 5ATN and 34.95 wt. % copper (II) oxide. The 5ATN as prepared in Example 1 and the dried copper oxide were combined to form an overall mass of 1.00 g. Enough water was added to form a slurry and then the components were mixed and ground with a mortar and pestle. The water was allowed to evaporate by holding the mixture at 70 degrees Celsius. Eventually, a sticky, polymer-like substance formed which became very hard with complete drying. The composition was tested by DSC at a heating rate of 10 degrees Celsius per minute and found to exhibit multiple exotherms beginning at about 137 degrees Celsius. This composition burned vigorously when ignited with a propane torch. This example demonstrates how 5ATN can be combined with a common oxidizer through either dry or wet mixing.

EXAMPLE 7

Figure 5:
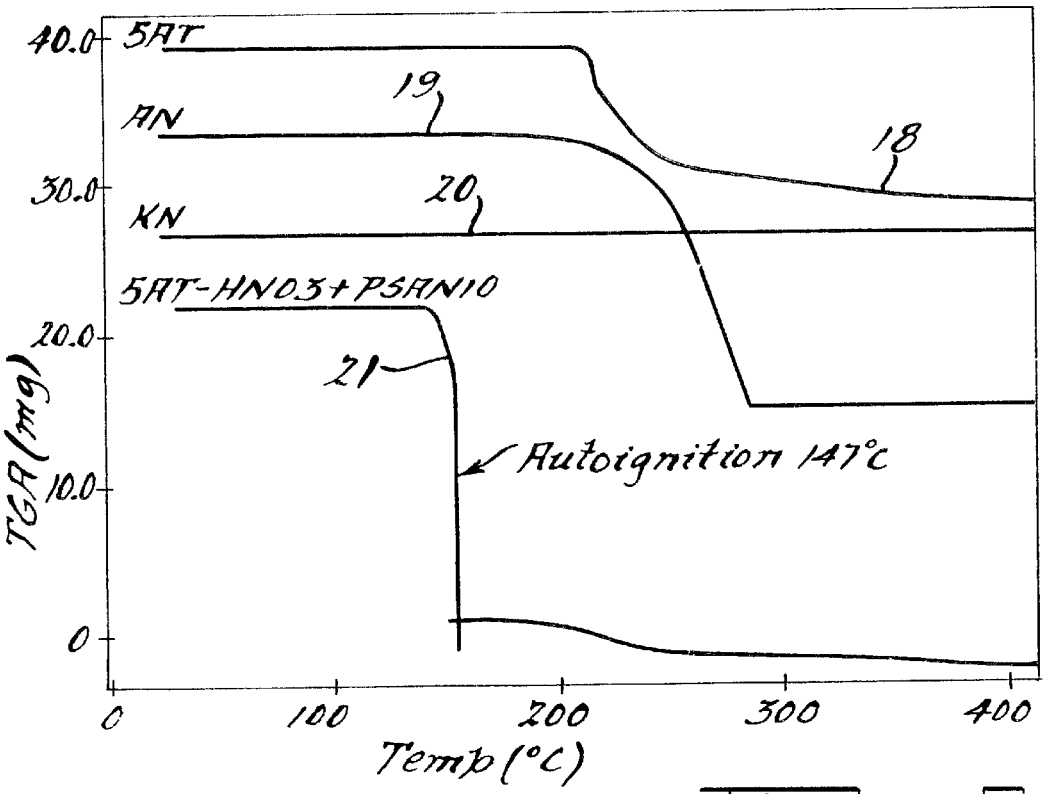
FIG. 5 illustrates the autoignition temperature of a preferred embodiment of the present invention.

A composition was prepared containing 67.01 wt. % 5ATN and 32.99 wt. % PSAN10 (AN phase stabilized with 10 wt. % KN). The 5ATN as prepared in Example 1 and the dried PSAN10 were combined to form an overall mass of 0.24 g and then mixed and ground with a mortar and pestle. FIG. 5 shows a melting point of 132° C. and a decomposition point of 153° C. See curve 17. The various constituents are also analyzed separately. See curves 14–16.

EXAMPLE 8

Figure 2:
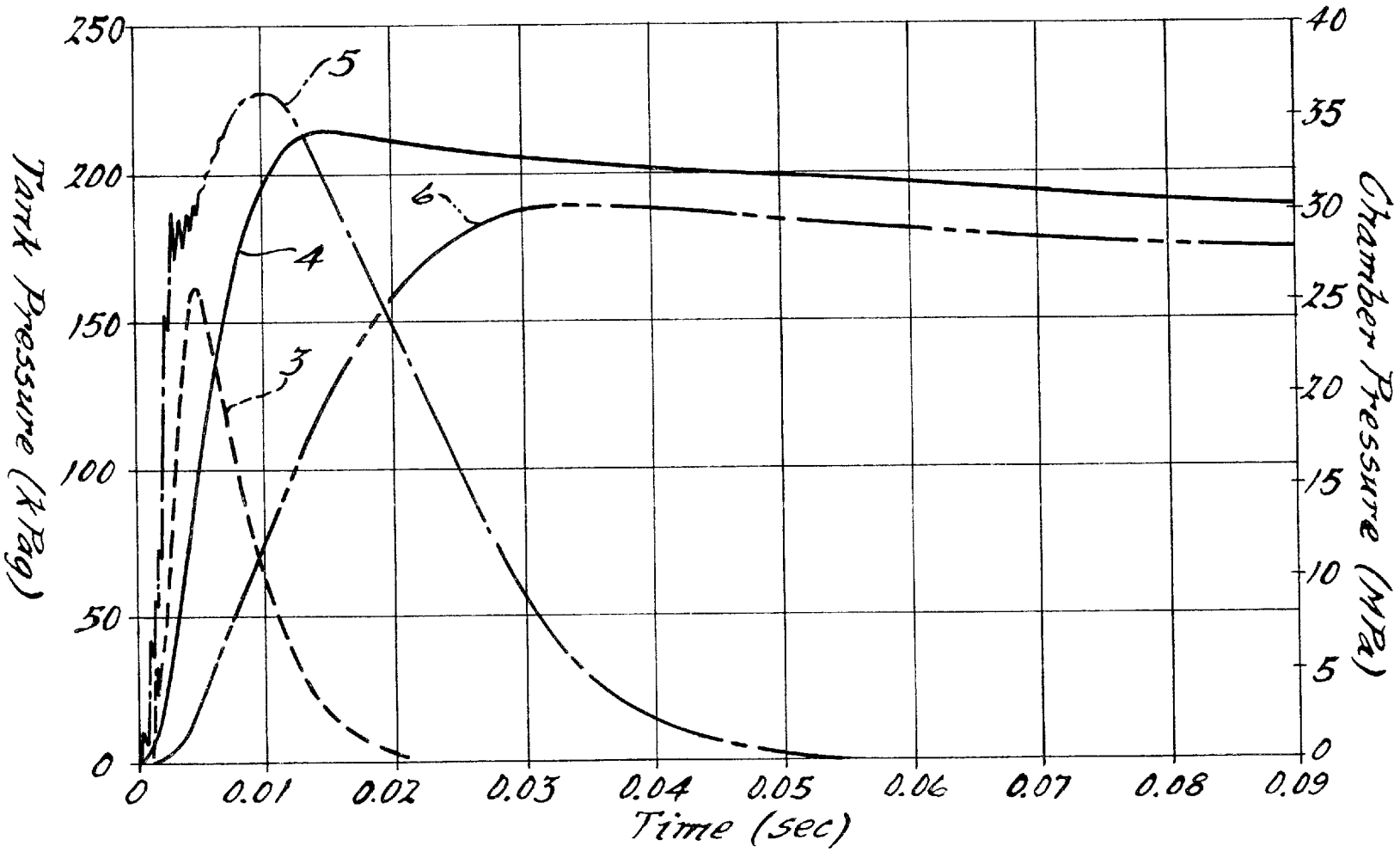
FIG. 2 illustrates the 60 L tank pressure and chamber pressure resulting from combustion of state of the art "smokeless" gas generants and a preferred embodiment of the present invention.
Figure 2:
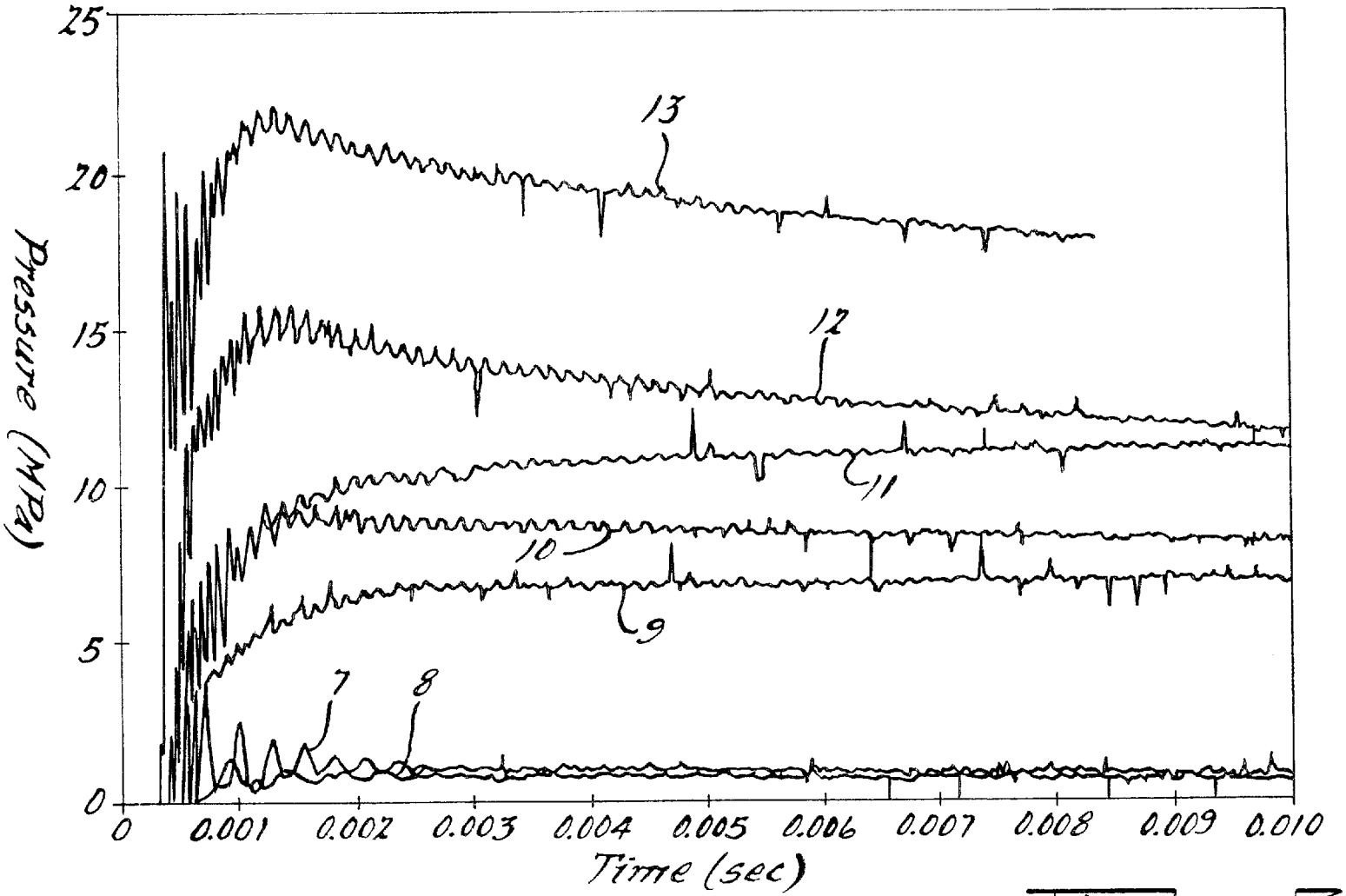

As FIG. 1 illustrates, gas generants of the present invention as exemplified by curve 1, have acceptable burn rates at ambient pressures and above, and have significantly higher burn rates as compared to state of the art "smokeless" gas generants (curve 2). Curve 1 indicates a gas generant containing 73.12% 5-ATN and 26.88% phase stabilized ammonium nitrate (stabilized with 10% potassium nitrate). Curve 2 is a comparison of a gas generant containing 65.44% phase stabilized ammonium nitrate (stabilized with 10% potassium nitrate or PSAN10), 25.80% of the diammonium salt of 5,5'-Bi-1H-tetrazole, 7.46% strontium nitrate, and 1.30% clay. The pressure exponent of the present invention, 0.71 is less than the pressure exponent of the state of the art "smokeless" gas generant of curve 2, 0.81. As shown in FIG. 2, a typical embodiment autoignites at 147° C. See curve 21. The gas generant constituents when taken alone do not indicate autoignition from 0–400° C.

EXAMPLE 9

FIG. 3 illustrates a comparison between a preferred embodiment containing the same fuel as curve 1 in Example 8. See curves 3 and 4. Curves 5 and 6 correspond to the same "smokeless" gas generant as indicated in curve 2 of Example 8. As curves 3 and 5 indicate, the chamber pressure resulting from combustion of the preferred embodiment is at 26 Mpa whereas the chamber pressure of the state of the art "smokeless" gas generant is 37 Mpa. On the other hand, as shown in curves 4 and 6, the 60 L tank pressures are approximately equivalent given the same inflator. The data can be interpreted to show that compositions of the present invention require less pressure but maintain superior burn rates (see FIG. 1) and thus are able to provide approximately equivalent inflation pressure for an airbag. As a result, a less robust inflator with a weaker ignition source may be used in compositions of the present invention. Compare the igniters used in FIG. 3 and Example 3.

EXAMPLE 10

Two compositions were prepared and tested. The burn rate was measured by igniting a compressed slug in a closed bomb at a constant pressure of 1000 psi. The ignitability of the formulations was determined by attempting to ignite the samples at ambient pressure with a propane torch. The outputs of the subjective analysis are the following: the time it takes for the sample to reach self-sustaining combustion after the torch flame touches the sample, and the ease of which the sample continues combustion when the torch flame is removed.

Formulation 1 was 73.12% 5-ATN and 26.89% PSAN10. The sample ignited instantly when touched with the flame from a propane torch and continued to burn vigorously when the flame was removed. The burn rate of this formulation at 1000 psi was measured to 0.69 inches per second (ips). To minimize the production of either CO or NOx, this composition was formulated to have an oxygen balance of −2.0 wt. % oxygen.

Formulation 2 was 62.21% azobisformamidine dinitrate and 37.79% PSAN10. When contacted with the flame from a propane torch, the sample did not ignite for a few seconds. After it appeared that self-sustaining combustion had begun, the torch was removed and the sample extinguished. After igniting the sample a second time, it burned slowly to completion. The burn rate of this formulation at 1000 psi was measured at 0.47 ips. To minimize the production of either CO or NOx, this composition was formulated to have an oxygen balance of 0.0 wt. % oxygen.

It is believed that the nitrated 5-AT fuel ignites more easily and burns faster for the following reasons:

1) The base 5-AT fuel has more energy (positive heat of formation) than the base azobisformamidine fuel (negative heat of formation).
2) The nitrated 5-AT has a higher oxygen content and therefore allows for the use of a lesser amount of the PSAN oxidizer. It is well known that the higher levels of PSAN will negatively affect the ignitability and burn rate of many propellant compositions.

EXAMPLE 11

TABLE 1 illustrates the problem of thermal instability when typical nonazide fuels are combined with PSAN:

| Nonazide Fuel(s) Combined with PSAN | Thermal Stability |
|---|---|
| 5-aminotetrazole (5AT) | Melts with 108 C. onset and 116 C. peak. Decomposed with 6.74% weight loss when aged at 107 C. for 336 hours. Poole '272 shows melting with loss of $NH_3$ when aged at 107 C.. |
| Ethylene diamine dinitrate, nitroguanidine (NQ) | Poole '272 shows melting at less than 100 C. |

TABLE 1-continued illustrates the problem of thermal instability when typical nonazide fuels are combined with PSAN:

| Nonazide Fuel(s) Combined with PSAN | Thermal Stability |
|---|---|
| 5AT,NQ | Melts with 103 C. onset and 110 C. peak. |
| 5AT,NQ quanidine nitrate (GN) | Melts with 93 C. onset on 99 C. peak. |
| GN, NQ | Melts with 100 C. onset and 112 C.. Decomposed with 6.49% weight loss when aged at 107 C. for 336 hours. |
| GN, 3-nitro-1,2,4-triazole (NTA) | Melts with 108 C. onset and 110 C. peak. |
| NQ, NTA | Melts with 111 C. onset and 113 C. peak. |
| Aminoguanidine nitrate | Melts with 109 C. onset and 110 C. peak. |
| 1H-tetrazole (1 HT) | Melts with 109 C. onset and 110 C. peak. |
| Dicyandiamide (DCDA) | Melts with 114 C. onset and 114 C. peak. |
| GN, DCDA | Melts with 104 C. onset and 105 C. peak. |
| NQ, DCDA | Melts with 107 C. onset and 115 C. peak. Decomposed with 5.66% weight loss when aged at 107 C. for 336 hours. |
| 5AT, GN | Melts with 70 C. onset and 99 C. peak. |
| Magnesium salt of 5AT | Melts with 100 C. onset and 111 C. peak. |

Figure 4:
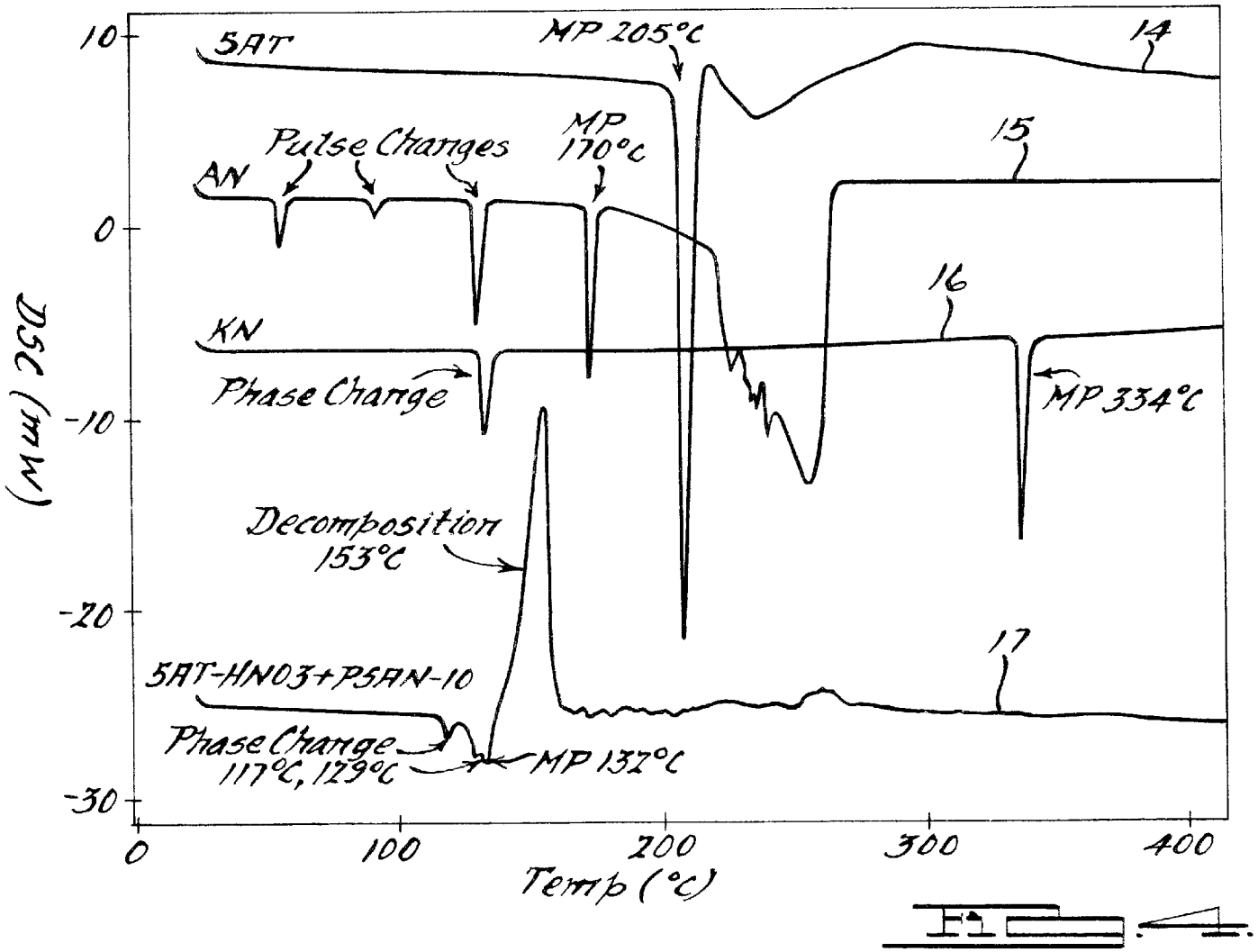
FIG. 4 illustrates the melting point and decomposition temperatures of a preferred embodiment of the present invention, as well as related data separately comparing the respective constituents of the preferred embodiment.
Figure 5:
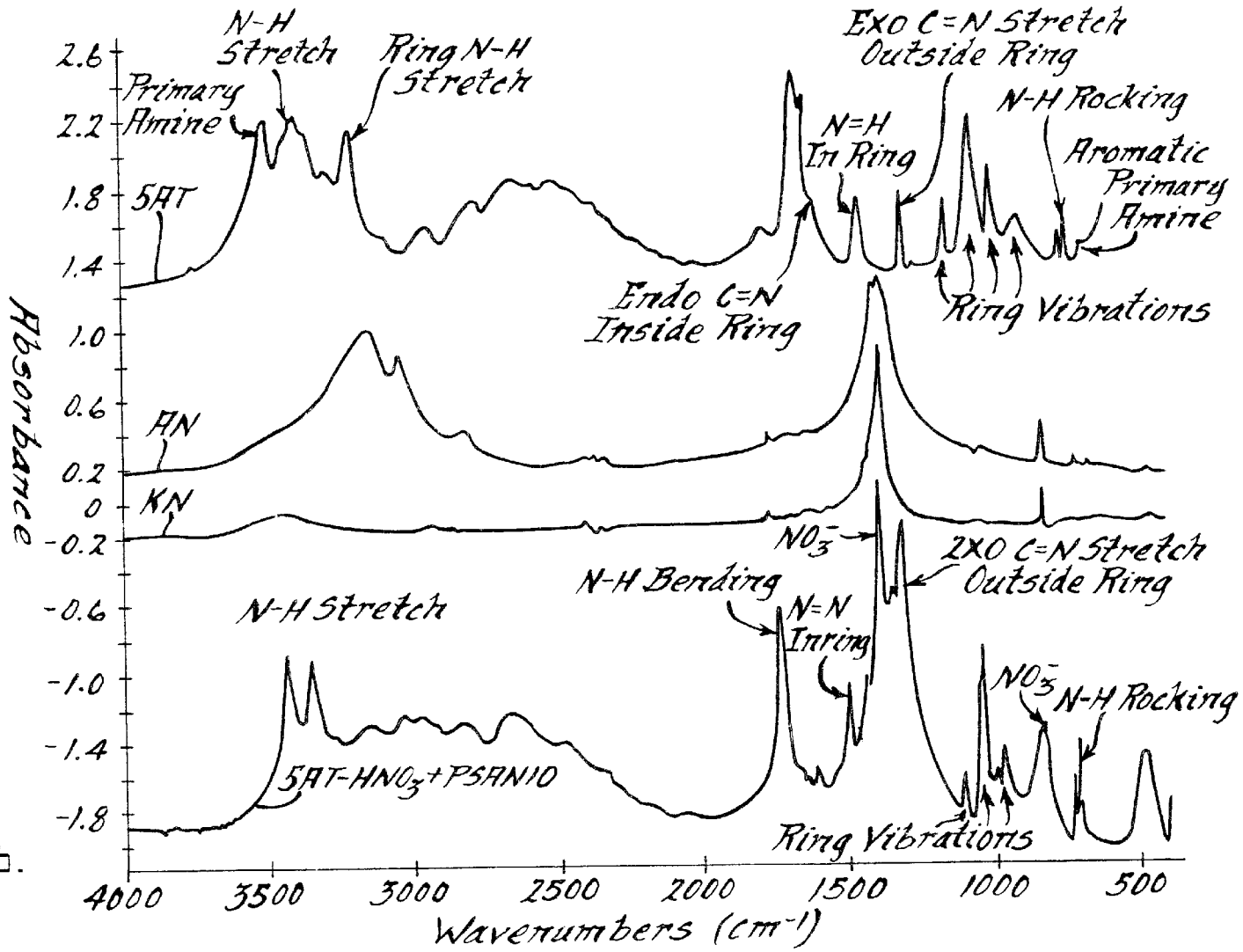

In Example 11, "decomposed" indicates that pellets of the given formulation were discolored, expanded, fractured, and/or stuck together (indicating melting), making them unsuitable for use in an air bag inflator. In general, any PSAN-nonazide fuel mixture with a melting point of less than 115 C. will decompose when aged at 107 C. As shown, many compositions that comprise well-known nonazide fuels and PSAN are not fit for use within an inflator due to poor thermal stability. As shown in FIG. 4 curve 17, the melting point of a preferred embodiment is greater than 115 C. (132 C.), thereby indicating that combining 5-ATN with PSAN does not significantly affect the stability of the propellant.

EXAMPLE 12

A composition containing 73.12% 5-ATN and 26.88% PSAN10 has been tested for sensitivity with the following results:

| | |
|---|---|
| Impact (BOE Apparatus) | 48 kp · cm |
| Friction (BAM Apparatus) | 120 N |
| Electrostatic Discharge | >900 mJ |

The preferred composition was compared to nitrocellulose, a standard gas generant for seat belt pretensioners. Gas yield, gas conversion, autoignition temperature, solids production, combustion temperatures, and density were roughly equivalent. Seat belt retractor tests also revealed fairly equivalent performance results. The following data was developed relative to nitrocellulose:

| | |
|---|---|
| Impact (BOE Apparatus) | 29 kp · cm |
| Friction (BAM Apparatus) | >360 N |
| Electrostatic Discharge | NA |

The preferred embodiment resulted in combustion gases containing 0.0% CO and 2.4% hydrogen, and 97.6% preferred gases containing nitrogen, carbon dioxide, and water. On the other hand, nitrocellulose resulted in combustion gases containing 29.2% CO and 19.7% hydrogen, and 51.1% preferred gases containing nitrogen, carbon dioxide, and water.

It can therefore be concluded that compositions of the present invention provide similar performance to nitrocellulose but with improved thermal stability, impact sensitivity, and content of effluent gases when used as a pretensioner gas generant.

EXAMPLE 13

Compositions containing 100% 5-ATN were used as pretensioner gas generants despite exhibiting an oxygen balance of −10.80 wt. % oxygen. The amount of gas generant used in a pretensioner is small enough (roughly one gram) to permit an excessive negative oxygen balance without prohibitive levels of CO.

EXAMPLE 14

As shown in Table 2, other compositions of the present invention include gas generants exhibiting oxygen balances in the range of −11.0 to +11.0. The oxygen balance may be readily determined by well known theoretical calculations. An oxygen balance of about +4.0 to −4.0% is preferred for compositions used in vehicle occupant restraint systems as main gas generants. Compositions exhibiting an oxygen balance outside of this range are useful as autoignition compounds or igniter compounds in an inflator; as a pretensioner gas generant; in a fire suppression mechanism; as a gas generant for an inflatable vessel or airplane ramp, or where levels of toxic gases such as CO and NOx are not critical for the desired use.

TABLE 2

| Composition | Gas Yield (moles/ 100 g) | Gas Conversion (wt % to gas) | Gas Products (vol. %) | Oxygen Balance (wt % O2) |
|---|---|---|---|---|
| Example 4 | 3.26 | 89.1 | 51.6% N2<br>32.3% H2O<br>16.1% CO2 | 0.0 |
| Example 5 | 2.64 | 72.1 | 50.0% N2<br>33.3% H2O<br>16.7% CO2 | 0.0 |
| 35% 5-ATN<br>41% PSAN10<br>24% NQ | 3.91 | 98.1 | 42.3% N2<br>47.5% H2O<br>10.0% CO2 | −2.16 |
| 39.4% 5-ATN<br>60.6% PSAN10 | 3.95 | 97.2 | 38.2% N2<br>47.9% H2O<br>6.7% CO2<br>7.2% O2 | +9.06 |
| 73.1% 5-ATN<br>26.9% PSAN10 | 3.82 | 98.8 | 46.4% N2<br>38.4% H2O<br>11.9% CO2<br>2.4% H2 | −2.0 |
| 60.0% 5-ATN<br>40.0% PSAN10 | 3.87 | 98.1 | 43.5% N2<br>44.2% H2O<br>10.5% CO2<br>1.8% O2 | +2.3 |
| 79.2% 5-ATN<br>20.8% PSAN10 | 3.80 | 99.0 | 48.7% N2<br>37.2% H2O<br>14.1% CO2 | −4.0 |

The oxygen balance is the weight percent oxygen necessary to result in stoichiometric combustion of the propellant. 5-aminotetrazole nitrate has a less negative oxygen balance than typical nonazide fuels and is considered to be self-deflagrating. This allows for compositions with significantly less PSAN (or other oxidizer) which will ignite more readily and combust at lower inflator operating pressures than previously known smokeless gas generants. Essentially, these compositions combine the benefits of the typical high-solids nonazide gas generants as exemplified by U.S. Pat. No. 5,035,757 to Poole (high burn rate, easily ignitable, low inflator operating pressures) with the benefits of PSAN-based smokeless nonazide gas generants exemplified in U.S. Pat. No. 5,872,329 to Burns et al. (90–100% gas conversion, minimal solids). The result is an inflator that is smaller, lighter, cheaper and less complex in design. Other well-known gas generant constituents may also be used in accordance with the present invention. See those described in the Background of the Invention, for example.

In yet another aspect of the invention, methods of formulating gas generant compositions containing 5-ATN, or any other nitrated base fuel, are described. The nitratable base fuels (i.e. the base fuels prior to nitration) include, but are not limited to nitrourea, 5-aminotetrazole, diaminotriazole, urea, azodicarbonamide, hydrazodicarbonamide, semicarbazide, carbohydrazide, biuret, 3,5-diamino-1,2,4-triazole, dicyandiamide, and 3-amino-1,2,4-triazole. Each of these base fuels may be nitrated and combined with one or more oxidizers. Thus, methods of forming gas generant compositions containing 5-ATN and one or more oxidizers, as described below but not thereby limited, exemplify the manufacture of gas generant compositions containing any nitrated base fuel and one or more oxidizers.

The constituents of the gas generant compositions may all be obtained from suppliers well known in the art. In general, the base fuel (5AT) and at least one oxidizer are added to excess concentrated nitric acid and stirred until a damp paste forms. This paste is then formed into granules by either extrusion or forcing the material through a screen. The wet granules are then dried. It has been found that the process not only forms a nitrated fuel, but also forms particularly intimate mixtures when the oxidizer is added in solution. The crystals formed thus represent homogeneous 5-AT nitrate/oxidizer solid solutions. This is particularly advantageous when homogeneous granules are desired because the probability of inconsistent mixing on the granular level is substantially reduced. Stated another way, the granules formed from the solid solution actually represent homogeneous solutions whereas a given granule formed from dry mixing, for example, at times may primarily comprise either the fuel or oxidizer, but not both. The performance and burn rate can therefore be disadvantaged.

The process also comprises a "one-pot" process. For example, if a composition containing 5-AT nitrate and PSAN is desired, then combining 5-AT, ammonium nitrate and potassium nitrate in a concentrated nitric acid solution results in a composition containing 5-AT nitrate and PSAN. Thus, two different processes are not required to form both the 5-AT nitrate and the PSAN, and yet a composition enjoying the inherent benefits of both results. Related benefits include simplified processing and a reduction in manufacturing costs.

The nitric acid can be the standard reagent grade (15.9M, −70 wt. % $HNO_3$) or can be less concentrated as long as enough nitric acid is present to form the mononitrate salt of 5AT. The nitric acid should preferably be chilled to 0–20° C. before adding the 5AT and oxidizers to ensure that the 5AT does not decompose in the concentrated slurry. However, shortening the process time will also inhibit the decomposition of 5AT. When mixing the 5AT and oxidizers in the nitric acid medium, the precise mixing equipment used is not important—it is necessary however to thoroughly mix all the components and evaporate the excess nitric acid. As with any process using acids, the materials of construction must be properly selected to prevent corrosion. In addition to routine safety practices, sufficient ventilation and treatment of the acid vapor is important.

After forming a wet paste as described above, several methods can be used to form granules. The paste can be placed in a screw-feed extruder with holes of desired diameter and then chopped into desired lengths. An oscillating granulator may also be used to form granules of desired size. The material should be kept wet through all the processing steps to minimize safety problems. The final granules can be dried in ambient pressure or under vacuum. It is most preferred to dry the material at about 30° C. under a −12 psig vacuum. Example 15 illustrates the process.

EXAMPLE 15

100 ml of concentrated nitric acid (15.9M, Reagent Grade from Aldrich) was added to a glass-lined, stirred, and jacketed vessel and cooled to 0° C. 10 g of dry 5AT (Nippon Carbide), 58 g of dry AN (Aldrich ACS Grade), and 6.5 g of dry KN (Aldrich ACS Grade) were then added to form a slurry in nitric acid. As the mixture was stirred, the excess nitric acid evaporated, leaving a doughy paste consisting of a homogeneous mixture of 174 g 5AT nitrate, 64.5 g PSAN10, and a small amount of nitric acid. This material was then passed through a low-pressure extruder to form long 'noodles' that were consequently chopped to from cylindrical granules. These granules were then placed in a vacuum oven at 30° C. and −12 psig vacuum overnight. After drying, the granules were screened and those that passed through a No. 4 mesh screen but not through a No. 20 mesh screen were retained.

A preferred method of formulating gas generant compositions containing 5-aminotetrazole nitrate and phase stabilized ammonium nitrate is described in Example 16. One of ordinary skill will readily appreciate that the following description merely illustrates, but does not limit, mixing of the constituents in the exact amounts of ingredients described. For example, other oxidizers may be used in lieu of PSAN.

EXAMPLE 16

100 ml of 70 wt. % $HNO_3$ solution equals 99.4 g (1.58 mol) $HNO_3$ plus 42.6 g (2.36 mol) $H_2O$. The solution is mixed by stirring in 100 g dry 5-aminotetrazole (5-AT) which equals 1.18 mol 5-AT, 58 g dry ammonium nitrate (AN), and 6.5 g potassium nitrate (KN) (10% of total AN+KN). The sequence of addition is not critical. As mixing occurs, 5-AT is converted into a nitric acid salt: 5-AT(1.18 mol=100 g)+$HNO_3$ (1.18 mol=74.4 g)=5-AT.$HNO_3$. The AN and KN dissolve in the water present. Excess $HNO_3$ (99.4 g−74.4 g=25 g) and $H_2O$ (42.6 g) evaporate as the mixture is stirred. As this occurs, AN (58 g) and KN(6.59) coprecipitate to form PSAN10 (64.5 g). Meanwhile, the 5-AT.$HNO_3$ formed while mixing is intimately mixed with the PSAN10. After mixing is complete, the end result is an intimate mixture of 174 g 5-AT.$HNO_3$+64.5 g PSAN10 with a small amount of $HNO_3$ and $H_2O$ to keep the mixture in a doughy or pasty form. Although potassium nitrate has been used to stabilize the ammonium nitrate, one of ordinary skill will readily appreciate that the ammonium nitrate may also be stabilized with other known stabilizers such as, but not limited to, potassium perchlorate and other potassium salts.

Granules or pellets are then formed from the paste by methods well known in the art. The granules or pellets are then dried to remove any residual $HNO_3$ and $H_2O$. The end product consists of dry granules or pellets of a composition containing about 73 wt. % 5-AT.$HNO_3$+27 wt. % PSAN10.

One of ordinary skill in the art will readily appreciate that the various amounts of the constituents described above can be varied to alter the combustion and ballistic properties of the gas generant compositions.

Although the components of the present invention have been described in their anhydrous form, it will be understood that the teachings herein encompass the hydrated forms as well. While the foregoing examples illustrate and describe the use of the present invention, they are not intended to limit the invention as disclosed in certain preferred embodiments herein. Therefore, variations and modifications commensurate with the above teachings and the skill and/or knowledge of the relevant art, are within the scope of the present invention.

We claim:

1. A method of formulating a gas generant composition comprising the steps of:

chilling a predetermined amount of nitric acid to 0–20 degrees Celsius;

adding a fuel selected from the group consisting of 5-aminotetrazole, diaminotriazole, azodicarbonamide, hydrazodicarbonamide, semicarbazide, carbohydrazide, biuret, 3,5-diamino-1,2,4-triazole, dicyandiamide, and 3-amino-1,2,4-triazole to the chilled nitric acid thereby forming a mixture wherein the nitric acid is diluted with water and is provided in a molarity and quantity at least sufficient to form a mononitrate of the fuel;

adding at least one oxidizer selected from the group consisting of nonmetal, alkali metal, and alkaline earth metal nitrates to the mixture;

stirring the mixture to form a wet paste wetted by nitric acid and/or water thereby precipitating a solid solution of the mononitrate of the fuel and the oxidizer;

forming the paste into a desired shape; and drying the wet formed paste to remove any residual nitric acid and/or water.

2. The method of claim 1 wherein at least one oxidizer is selected from the group consisting of ammonium nitrate, potassium nitrate, and strontium nitrate.

3. The method of claim 1 wherein the nitric acid has a molarity of 15.9M or less.

4. A method of formulating a gas generant composition comprising the steps of:

chilling a predetermined amount of nitric acid to 0–20 degrees Celsius;

adding 5-aminotetrazole to the chilled nitric acid to form a slurry, the nitric acid diluted by water and provided in at least a sufficient molarity and quantity to form 5-aminotetrazole nitrate;

adding ammonium nitrate and potassium nitrate to the slurry wherein potassium nitrate is about 10% by weight of the combined weight of the ammonium nitrate and the potassium nitrate;

stirring the slurry to form a wet paste, thereby forming a solid solution containing 25–95% 5-aminotetrazole nitrate and 5–75% phase stabilized ammonium nitrate;

forming the paste into a desired shape; and drying the formed paste to remove any residual nitric acid and/or water.

* * * * *